US006129578A

United States Patent [19]

McCarrick et al.

[11] Patent Number: 6,129,578

[45] Date of Patent: Oct. 10, 2000

[54] WIRING DEVICE WITH ELECTRICAL CIRCUIT-IDENTIFYING MEANS

[75] Inventors: Robert A. McCarrick, Milford; Joseph V. DeBartolo, Jr., North Stonington, both of Conn.

[73] Assignee: Hubbell Incorporated, Orange, Conn.

[21] Appl. No.: 09/228,517

[22] Filed: Jan. 11, 1999

[51] Int. Cl.[7] ..... H01R 3/00

[52] U.S. Cl. ..... 439/488; 174/66

[58] Field of Search ..... 439/490, 491, 439/488; 174/66

[56] References Cited

U.S. PATENT DOCUMENTS 4,353,759 10/1982 Stallings ..... 156/64

5,769,653 6/1998 Osterbrock et al. ..... 439/491

5,832,641 11/1998 Osterbrock et al. ..... 40/299

*Primary Examiner*—Neil Abrams

*Assistant Examiner*—Brian S. Webb

*Attorney, Agent, or Firm*—Jerry M. Presson; Leopold Presser

[57] ABSTRACT

A wiring device incorporating contrasting areas for having electrical circuit-identifying indicia or legends written thereon, and more particularly, a wiring device incorporating means for identifying diverse electrical circuitry through the application onto the device of indicia or legends written on a surface of preferably contrasting colors. Furthermore, disclosed is a method of imparting through imprinting color contrasting areas for the writing thereon of indicia or legends to a wiring device for the purpose of being able to identify at least one electrical circuit which is a plurality of electrical circuits which are connected to the wiring device.

16 Claims, 1 Drawing Sheet

WIRING DEVICE WITH ELECTRICAL CIRCUIT-IDENTIFYING MEANS

BACKGROUND OF THE INVENTION

1. Field of the Invention

The present invention relates to a wiring device incorporating electrical circuit-identifying indicia or legends, and more particularly, pertains to a wiring device incorporating means for identifying diverse electrical circuitry through the application onto the device of indicia or legends written onto an imprinted area of a contrasting color. Furthermore, the invention is also directed to a provision of a novel method of imparting an imprinted color contrasting background for indicia or legends to a wiring device for the purpose of being able to identify at least one electrical circuit or plurality of electrical circuits which is or are connected to the wiring device.

Wiring devices; such as for example, wall-mounted switches or receptacles which may incorporate plug-receiving structure have for many years been employed in the electrical industry, wherein a plurality of wiring devices are connected to a single electrical circuit so as to reduce or eliminate any danger of potentially exceeding rated circuit capacity by combined loads which are connected to the wiring devices. Consequently, fuses or circuit breakers or boxes may be equipped with a number of terminals for the purpose of connecting the wires from at least one or more of the wiring devices to an electrical power source in separate circuits, each circuit possessing a predetermined electrical current capacity which may not be exceeded in order to avoid the possibility of overloads leading to potential fire hazards.

Upon occasion, when it becomes necessary to either replace or repair exposed wiring of a wiring device, the circuit in which the wiring device is located, is normally deenergized by the opening of a circuit breaker or by removing a fuse and thereafter disconnecting the wire device from the power source in order to implement the desired servicing. Although this is generally a relatively simple procedure to accomplish for an experienced electrician or installer, it is not always readily possible to correctly identify the specific circuit to which a particular wiring device has been previously connected, and to which a wiring device is to be correctly reconnected.

Accordingly, it is essential to be able to provide some assurance that the appropriate wiring device and attendant electrical circuit has been disconnected from the electrical power source in order to facilitate the repair or replacement thereof, in complete safety. Heretofore various diverse methods have been employed in marking the wiring devices with an electrical circuit-identifying legend or the like.

2. Discussion of the Prior Art

The foregoing problem has been previously addressed, in particular, by the disclosures of U.S. Pat. Nos. 2,625,759 and 4,479,317, in which folded blanks were installed under the wall plate of a wiring device, and which carried a sliding member having circuit-identifying indicia provided thereon. The mounting of the sliding member facilitated movement in and out thereof without having to necessarily remove the wall plate.

In contrast with the foregoing, other publications set forth arrangements which included separate transparent plates incorporating panel structure providing for circuit identifying-indicia being installed in surrounding relationships about the wiring device; in essence, between the wall plate and the wall on which the wiring device was mounted. This arrangement required providing the identifying indicia on the inside of the wall plate by means of a felt-tipped pen or highlighting marker, which could be misinterpreted in the event that the wall plate was erroneously misplaced or incorrectly attached by an electrician.

More recently, the disclosure of U.S. Pat. No. 5,769,653 set forth a wiring device with an electrical circuit-identification structure wherein identifying legends or indicia were imparted to a separate sheet of paper or similar material which is adapted to be adhesively fastened to a surface area proximate a plug-receiving female socket structure of a wiring device which serves as a wall-mounted device adapted to be covered by a wall plate. However; the use of written-on separate pieces of paper similar types of delicate materials applied onto wiring devices frequently deteriorates; possibly due to moisture being entrapped under the wall plate, or because of other variable thermal and humidity conditions to which the electrical wiring device is subjected. This; in essence, may readily cause the electrical circuit-identifying indicia to become illegible are even to be completely destroyed, thereby negating the value thereof to an electrician or installer.

SUMMARY OF THE INVENTION

Accordingly, in order to ameliorate or eliminate the problems encountered in the prior art with regard to the capability of imparting electrical circuit-identifying means to a wiring device which is connected to at least one or more electrical circuits, and in order to substantially provide a foolproof and indelible identification system to such wiring devices, there is contemplated the application of an essentially contrasting color circuit-identification system. A contrasting color is applied by suitable printing to a surface portion of the electrical wiring device; for instance, such as a wall-mountable unit of the type including plug-receiving electrical connections, wherein circuit-identifying indicia or legends are adapted to be written on the contrastingly colored surface area of the device which is adapted to be exposed so as to be clearly visible to an electrician or installer upon the removal of a covering structure, such as a wall plate.

Basically, a generally planar or flat surface area which is provided on a forwardly facing portion of the wiring device lies the area imprinted in an indelible contrasting color or colors. Indicia or legends may then be inscribed or written on the colored area in order to provide information with regard to specific types of electrical circuits which are connected to the wiring device, the legends or indicia being preferably in the form of alphanumeric writing.

In order to be able to impart the electrical circuit-identifying indicia or legends to the contrasting colored surface area or front surface portion of the wiring device, various types of printing modules or imprinting methods for coloring the surface of the wiring device can be readily employed by the invention. For instance, preferred printing methods maybe through the use of pad printing, hot stamping, or silk screening among other types of printing methods which could also be conceivably applied to the surface area of the device within the inventive concept. The foregoing types of printing methods of providing the contrasting color surface area can be easily implemented at the time of installation of the wiring devices; for example, during the wall mounting thereof or alternatively, in some instances, the colored area can be imprinted on the wiring devices, during the initial manufacture of the wiring devices, in conformance with customer requirements.

Accordingly, it is an object of the present invention to provide a wiring device for one or more electrical circuits which incorporates indelibly imprinted contrastingly colored surface areas adapted to have electrical circuit-identifying indicia or legends written thereon.

Another object of the present invention resides in the provision of a wiring device for electrical circuits including the application by printing thereon of contrasting color surface areas whereby electrical circuit-identifying indicia or legends can be written on the colored surface areas of the wiring device.

Still another object of the present invention resides in the provision of an electrical wiring device of the type described, wherein electrical circuits which are connected to the device maybe readily identified on the wiring device through the intermediary of printing of indelible contrasting color surface areas on the device adapted to have electrical circuit-identifying indicia or legends written thereon.

A further object of the present invention resides in the provision of an electrical wiring device for electrical circuits wherein electrical circuit identifying-indicia are adapted to be written on contrasting colored areas of the device found through the intermediary of either pad printing, hot stamping or silk screening and the like.

A still further object of the present invention resides in the provision of a method for applying imprinting in a contrasting color on a surface area of a wiring device adapted to have electrical circuit-identifying information subsequently written thereon, with the contrasting color being applied to the device by printing methods selected from pad printing, hot stamping or silk screening and the like.

BRIEF DESCRIPTION OF THE DRAWINGS

Reference may now be had to the following detailed description of a preferred embodiment of the invention, taken in conjunction with the accompanying drawings; in which.

DETAILED DESCRIPTION OF A PREFERRED EMBODIMENT

Figure 1:
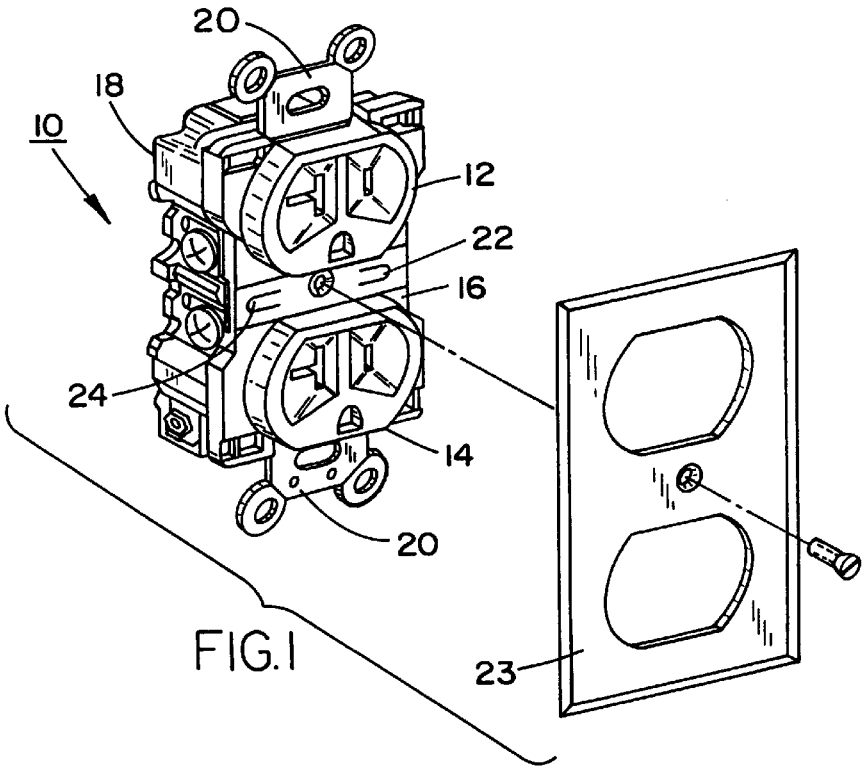
FIG. 1 illustrates a perspective exploded view of a wiring device in the form of a wall-mountable plug-receiving connector which is adapted to be covered by a wall plate.
Figure 2:
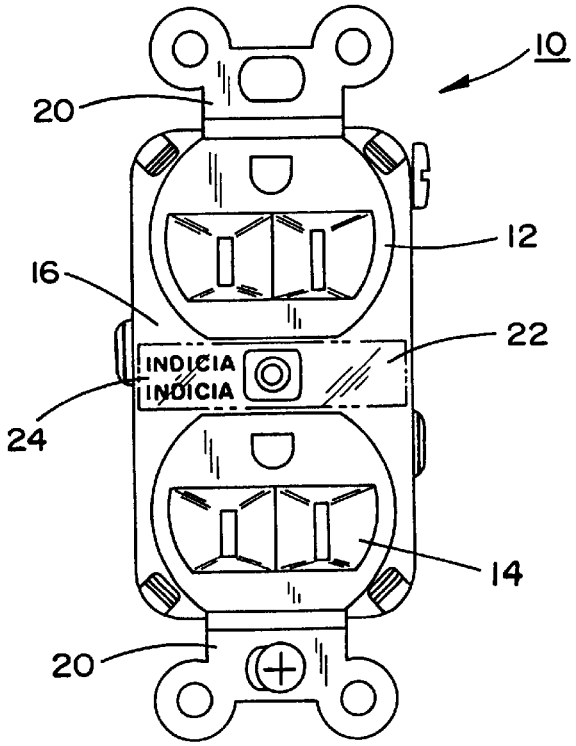
FIG. 2 illustrates the wiring device of FIG. 1 in a front view represented as being mounted on a wall or surface, and incorporating the imprinted contrasting color surface area which is adapted to have electrical circuit-identifying indicia or legends subsequently written or marked thereon.

Referring now in specific detail to FIG. 1 of the drawings, there is illustrated a wiring device 10, such as a wall-mountable receptacle which includes a pair of plug-receiving female connectors 12, 14 arranged in tandem, or spaced one above the other. The wiring device 10 includes a flat front surface portion 16 between the connectors 12, 14 adapted to face forwardly towards a wall surface on which the device 10 is mounted, and a rear portion 18 providing for electrical connections to various kinds of electrical circuitry (not shown) which is to be identified by means of the present invention.

Suitable positioning lugs or ears 20 may be attached to the upper and lower front surface portions of the receptacle or wiring device, and structure incorporated in order to be able to mount the device flush against a surface of the mounting-wall, and with appropriate screw connectors adapted to be provided for attaching the wiring device to a junction or terminal box, as is well known in this technology.

Arranged intermediate the two plug-receiving connectors 12, 14 of the receptacle or wiring device is a relatively flat or planar surface area 22 which is adapted to be facing forwardly, whereby upon removal of a wall plate 23 which may cover the wiring device 10 subsequent to mounting the latter on a wall surface or the like, by loosening a fastener screw connected to the wall plate, planar surface area 22 is exposed to the view of an installer or electrician who is either installing, repairing or replacing the wiring device 10.

In order to be able to impart the desired written or marked indicia or legends for identifying electrical circuits to the surface of the wiring device 10 by an electrician or installer of the wiring device, the surface area 22 on which the indicia or legends identifying the particular electrical circuits which are to be connected to the device, is imprinted to form a colored surface by an imprinting process using a contrasting color or colors. The contrasting color 24 is applied to the surface area 22 through either pad printing, hot stamping, or silk screening, although other suitable printing methods could also be conceivably readily employed by means of the present invention.

Upon directly imprinting the surface 22 of the wiring device 10 with the contrastingly colored surface area 24, this eliminates the need for the application of separate strips of paper or such readily damageable or destroyable components, or erasable lettering wherein deleterious conditions to which the wiring device 10 may be subjected over extended periods of use may cause the printing on such strips of paper or the like to be destroyed or rendered illegible in that the paper strip or the like either shrivels or deteriorates due to humidity or presence of water, or through the effects of heat which may be encountered beneath the wall plate 23 during such extended use of the wiring device or receptacle.

In summation, the foregoing inventive concept provides for a basically foolproof method and system of imparting preferably indelible, contrastingly colored electrical surface areas adapted have circuit-identifying legends written thereon to electrical wiring devices which are connected to diverse electrical circuits, and implementable in a generally inexpensive and easily imparted manner. In addition to the foregoing, it is also possible that the contrasting color system of applying printed areas on the device for enabling the electrical circuit-identifying indicia or legends to be written thereon, may utilize more than one contrasting color rather than being imprinted monochromatically, thereby rendering the invention still more versatile to an electrician or installer.

While there has been shown and described what is considered to be a preferred embodiment of the invention, it will, of course, be understood that various modifications and changes in form or detail could readily be made without departing from the spirit of the invention. It is, therefore, intended that the invention be not limited to the exact form an detail herein shown and described, nor to anything less than the whole of the invention herein disclosed as hereinafter claimed.

What is claimed is:

1. A wall-mountable wiring device which is connected to at least one electrical circuit, said wiring device having at least one surface area facing towards a wall opening in a wall for mounting said wiring device, said at least one surface area comprising:

(a) a generally smooth-textured surface portion; and (b) at least one contrasting indelible color being imprinted on said surface portion; imparting to said surface position a colored background distinguishing from surrounding surface areas of said wiring device; and providing for contrastingly colorated writing on said colored background representative of electrical circuit-identifying indicia or legends.

2. A wiring device as claimed in claim 1, wherein said contrasting color is applied to said surface portion by pad printing.

3. A wiring device as claimed in claim 1, wherein said contrasting color is applied to said surface portion by hot stamping.

4. A wiring device as claimed in claim 1, wherein said contrasting color is applied to said surface portion by silk screening.

5. A wiring device as claimed in claim 1, wherein said wiring device is connected to a plurality of electrical circuits, said contrasting color surface portion being adapted to have indicia identifying at least selective of said electrical circuits subsequently written thereon.

6. A wiring device as claimed in claim 5, wherein said wiring device includes at least two plug-receiving portions adapted to provide communication with electrical connections, said surface portion having said contrasting color imprinted thereon for the identifying of said selective electrical connections being located intermediate said plug-receiving portions.

7. A wiring device as claimed in claim 1, wherein a wall plate is mountable on said wiring device in covering superposition over said surface portion having said contrasting color imprinted thereon.

8. A method of imparting electrical circuit-identifying indicia to a surface portion of a wiring device; comprising applying a contrasting indelible color to said surface portion so as to form a background distinguishing from surrounding surface areas of said wiring device; and writing electrical circuit identifying-indicia on said contrastingly colored background surface portion.

9. A method as claimed in claim 8, wherein said wiring device is connected to at least one said electrical circuit identified by indicia or legends written on said contrasting color surface portion.

10. A method as claimed in claim 9, wherein said wiring device is connected to a plurality of electrical circuits, said contrasting color surface portion having indicia written thereon for identifying at least selective of said electrical circuits.

11. A method as claimed in claim 10, wherein said wiring device includes at least two plug-receiving portions for communication with said electrical connections by external contact elements, said surface portion having said contrasting color imprinted thereon being arranged intermediate said plug-receiving portions.

12. A method as claimed in claim 8, wherein said contrasting color is applied to said surface portion by pad printing.

13. A method as claimed in claim 8, wherein said contrasting color is applied to said surface portion by hot stamping.

14. A method as claimed in claim 8, wherein said contrasting color is applied to said surface portion by silk screening.

15. A method as claimed in claim 8, wherein said wiring device is a wall-mountable receptacle unit.

16. A method as claimed in claim 15, wherein a wall plate is mountable on said wiring device in covering relationship over said imprinted contrasting color surface portion.

* * * * *